United States Patent [19]

Vangaever et al.

[11] 4,451,336

[45] May 29, 1984

[54] ADDITIVE-FREE, FAST PRECIPITATING PALLADIUM ELECTROLYTE BATH AND PROCESS

[75] Inventors: Frank Vangaever; Jacky Vanhumbeeck, both of Brugge; Laurent Danneels, Varsenare; Luc Boone, Oostkamp; Luc Demaegd, Drongen, all of Belgium

[73] Assignee: Siemens Aktiengesellschaft, Berlin & Munich, Fed. Rep. of Germany

[21] Appl. No.: 443,011

[22] Filed: Nov. 19, 1982

[30] Foreign Application Priority Data

Dec. 9, 1981 [DE] Fed. Rep. of Germany ..... 3148788

[51] Int. Cl.[3] ..... C25D 3/50

[52] U.S. Cl. ..... 204/47

[58] Field of Search ..... 204/47, 109; 106/1.28

[56] References Cited

U.S. PATENT DOCUMENTS 3,925,170 12/1975 Skomoroski et al. ..... 204/43 N 4,242,180 12/1980 Heppner et al. ..... 204/43 N

FOREIGN PATENT DOCUMENTS 2939920 9/1981 Fed. Rep. of Germany ... 204/43 N 2090866 7/1982 United Kingdom ..... 204/47

354010 9/1972 U.S.S.R. ..... 204/47

*Primary Examiner*—G. L. Kaplan

*Attorney, Agent, or Firm*—Hill, Van Santen, Steadman & Simpson

[57] ABSTRACT

An additive-free, fast-precipitating electrolyte bath for precipitating lustrous, crack-free palladium layers on workpieces is formulated, by successively adding to distilled water heated up to about 90° C., phosphoric acid, sufficient ammonia to neutralize the phosphoric acid and palladium, in the form of palladium chloride. After dissolution of the palladium salt, the operating pH value is adjusted by additions of ammonia or phosphoric acid as required and the volume of the bath can be increased as desired by additions of further distilled water. The bath can be filtered prior to use.

10 Claims, No Drawings

ADDITIVE-FREE, FAST PRECIPITATING PALLADIUM ELECTROLYTE BATH AND PROCESS

BACKGROUND OF THE INVENTION

1. Field of the Invention

The invention relates to electroplating of palladium onto various workpieces and somewhat more particularly to an improved palladium electrolyte bath and a method of plating with such a bath.

2. Prior Art

Palladium is plated onto various workpieces for decorative and/or technical purposes and various palladium electrolyte baths are known. One basically distinguishes between alkaline and acidic palladium baths. Luster or brightener additives are usually added to these baths for the formation of lustrous layers. As a result of the bath compostions and these additives, a danger exists that foreign components, such as, for example, sulfur, will be incorporated into the precipitated palladium layers. Such foreign components can give rise to the formation of cracks and the like in the deposited layer and can give rise to poor corrosion resistance.

Palladium baths functioning in the acidic range are usually characterized by low stability of the palladium complex, by a relatively low precipitation rate (1 thru 8 μm per minute) and by high manufacturing cost. However, these baths are advantageous in that they allow a 100% current efficiency and, therefore, the deposited coatings attained therefrom are usually crack-free.

Known alkaline palladium baths are formulated on the basis of ammonia complexes or amine compounds. With such alkaline baths, it is usually very difficult to maintain a constant pH value. A further disadvantage of alkaline baths is that they exhibit a very low precipitation rate (only 0.25 to 1 μm per minute). Further, coatings or layers deposited from these baths tend to develop cracks, either because of the use of luster promoters, which lead to internal stresses or due to a current efficiency which is less than 100%, because hydrogen generated during precipitation is incorporated into the precipitated layers (as is known, hydrogen is absorbed by palladium to a very high degree). Moreover, with ammonia-containing baths, the constant evaporation of ammonia, which occurs during electroplating operations, requires involved ventilation devices for odor/-corrosion control.

An ammonia-free aqueous palladium electrolyte bath is described in German Offenlegungsschrift No. 26 57 925, which corresponds to U.S. Pat. No. 4,242,180, wherein, among other things, palladium chloride is utilized in formulating the bath. However, with this electrolyte bath, only very low precipitation rates are attainable as a result of very low current densities (about 1 A/dm$^2$) compatible with these baths.

Further prior art, for example, German Offenlegungsschrift 29 39 920, describes the use of numerous palladium compounds, such as $PdCl_2$, $Pd(OH)_2$, $K_2Pd(NO_2)_4$, $Pd(NH_2SO_3)_2$, $Pd(NH_3)_2Cl_2$ and $Pd(NH_3)_2(NO_2)_2$ in forming palladium electrolyte baths.

SUMMARY OF THE INVENTION

The invention provides an improved additive-free, fast-precipitating, palladium electrolyte bath which allows the precipitation of lustrous, crack-free palladium layers on various workpieces and which is very economical to manufacture and allows high precipitation rates of at least about 10 to 25 μm per minute with a 100% current effeciency. Further, any and all luster of brightener additives can be totally eliminated and a high bath stability is attained. In order to attain a durable corrosion resistance, the precipitated layers should be free of sulfur and, accordingly, sulfur-containing materials are to be avoided.

In accordance with the prinicples of the invention, additive-free, fast-precipitating electrolyte baths for precipitating palladium layers on workpieces are formulated by successively adding, to distilled water heated up to about 90° C., phosphoric acid, sufficient ammonia to about neutralize the phosphoric acid and palladium, in the form of palladium chloride and then adjusting the operating pH value of the resultant bath to about 6.5 through 8.5 by additions of ammonia or phosphoric acid as required. The bath can be adjusted to a final desired volume by additions of further distilled water and it may be filtered prior to use.

In a preferred embodiment of the invention, a one liter electrolyte bath of the invention is formulated by successively adding to about 600 ml of distilled water heated up to about 90° C., about 10 through 100 ml of phosphoric acid having a density of about 1.71, sufficient 25% aqueous ammonia to neutralize the phosphoric acid and about 5 through 40 gr of palladiuim chloride and then adjusting the operating pH value of the resultant bath, after the palladium chloride has dissolved, to about 6.5 through 8.5 by additions of ammonia and/or phosphoric acid as required, adding sufficient distilled water to attain a one liter volume and filtering the final bath before use.

The inventive palladium electrolyte bath is particulary advantageous because it is formulated directly on the basis of palladium chloride, one of the most economical palladium salts.

Method embodiments of the invention comprise electrolytically precipitating lustrous, crack-free palladium layers by formulating the above-described electrolyte bath, adjusting the bath temperature so as to range from about 20° to 80° C. and positioning a workpiece to be electroplated in working relation with the bath, applying an electrical current having a density of about 10 to 180 A/dm$^2$ across said bath and workpiece and moving the electrolyte past surfaces of the workpiece which are to be electroplated.

In one embodiment, movement of the electrolyte is accomplished by stirring the electrolyte bath with a rotating disc electrode, for example comprised of an outer non-conductive cylindrical body having a diameter of about 10 mm and and a metallic electrode disc at least partially embedded into the bottom of said body and having a diameter of about 2 mm and driving or operating such rotating disc electrode at a rotational speed of about 3,600 to 10,000 rpm.

In another embodiment, movement of the electrolyte is accomplished by spraying the electrolyte bath against surfaces of the workpiece to be electroplated at a rate of about 1 to 15 ml/sec per unit area of of the workpiece surface. Preferably, the spraying occurs by pumping the electrolyte bath through a spray cell arrangement comprised of a plurality of spray nozzles positioned in at least one row extending in a given direction and in fluid communication with a reservoir for the bath, each nozzle having an individual stream of electrolyte emerging unimpeded therefrom so as to impinge against at least a portion of the workpiece surface. The workpiece is moved, continuously or intermittently, along the given direction of the extended nozzles so as to be contacted by the streams of electrolyte emerging from the individual nozzles to enable a free and unimpeded electroplating of workpiece surface areas contacted by the electrolyte streams. In preferred embodiments, each nozzle has a nozzle diameter of about 2 mm and the electrolyte is pumped at a rate of about 1 to 15 ml/sec. Further details of a suitable spray cell arrangement can be attained from, for example, commonly assigned co-pending patent application Ser. No. 344,060 filed Jan. 29, 1982, which is incorporated herein by reference.

In certain method embodiments of the invention, portions of the workpiece not in direct contact with the electrolyte are constantly moistened by the electrolyte, for example by providing a trough or rail in working relation with the bath and the workpiece so that the non-contacted portions of the workpiece are immersed in the electrolyte within the trough or on the rail.

By practicing the principles of the invention, it has been shown that superior quality palladium layers can readily be attained. No cracks or the like could be found, even with a magnification of 15,000. With a preferred bath operating pH value of about 7.3, the free ammonia content is so slight that substantially no odor occurs and no corrosion of the treated materials or the plating system occurs. Moreover, the pH stability of the inventive bath is better than with other known alkaline baths. In the inventive bath, the palladium does not tend toward self-reduction so that a high stability of the bath is attained.

The inventive palladium electrolyte bath is preferably utilized in continuously operating electroplate systems wherein select workpieces, composed of a metal, such as copper, iron (or steel) and like metal alloys typically used in forming contact elements in electrical devices, circuits, etc., are undergoing treatment. The palladium bath of the invention can, under certain conditions, be used for partially coating imperforated workpiece surfaces as well as for coating of perforated workpiece surfaces, such as plug-type connectors and the like, which are joined with one another along select portions thereof to form a ribbon or tape-like body that can be continuously fed through an electroplating system.

As indicated earlier, an increased electrolyte movement is achieved by spraying the electrolyte onto the workpiece with spray nozzles. In this instance, the nozzles form the anode (i.e., are connected to an anode terminal of an electrical current source) and the travelling tape-like workpiece forms the cathode (i.e., is connected to a cathode terminal of the electrical current source). With a spray cell arrangement as described earlier and operating in a continuous fashion, the free ends (i.e., those portions of the workpiece not directly contacted by the sprayed electrolyte) of the workpiece sprayed with the electrolyte are preferably constantly moistened with electrolyte by, for example positioning such free ends in a suitable trough or the like having electrolyte therein. An ion depletion in the electrolyte, which would lead to scorching of the workpiece or, respectively, to precipitation of non-lustrous layers, is prevented by the constant moistening of, for example, the lower free ends of the components forming the workpiece being treated. Instead of a trough, a rail or the like can be positioned below the bath in such a manner that a slight electrolyte back-up is formed on the rail and the ends of the components forming the workpiece are emersed into this electrolyte back-up.

Lustrous, pore-free deposited palladium layers can readily be attained by a proper selection of anode-cathode spacing, electrolyte movement and current density. Bath control is relatively simple because only the pH value and palladium content need be monitored and adjusted as required.

DESCRIPTION OF PREFERRED EMBODIMENTS

The present invention is further illustrated by reference to the following specific examples. Those skilled in the art will appreciate that other and further embodiments are obvious and within the spirit and scope of the invention from the teachings of the present examples taken in conjunction with the accompanying specification.

The specified quantities for the individual components relate, in each case, to a one liter aqueous bath. The individual bath components are phosphoric acid ($H_3PO_4$) having a density of 1.71, ammonia ($NH_4OH$) as a 25% aqueous solution, palladium chloride ($PdCl_2$), 99.9% pure and distilled water.

In the examples, either a rotating disc electrode having a non-conductive outer diameter of 10 mm and a conductive disc diameter of 2 mm as explained earlier or a spray cell arrangement having a nozzle diameter of 2 mm as explained earlier are utilized to achieve electrolyte movement. In all examples, a current efficiency of 100% is attained and lustrous to silky gloss, crack-free layers are realized.

EXAMPLE 1

600 ml of distilled water are heated to about 60° to 95° C. and maintaned at this temperature while the following components are successively added to the heated water:

20 ml of phosphoric acid, 220 ml of ammonia and 30 gr of palladium, in the form of palladium chloride. After the palladium salt is dissolved (it will be appreciated that the higher the temperature of the distilled water is, the faster the dissolution rate will be), the pH value of the bath is adjusted to 7.3 by additions of ammonia or phosphoric acid, as required and the bath is supplemented with distilled water to form a one liter solution.

The foregoing bath produces lustrous, crack-free palladium layers on a workpiece by adjusting the bath temperature of about 60° to 65° C. and applying a current with a density of about 75 A/dm$^2$ across the bath and workpiece, while rotating a disc electrode at about 5,000 rpm in the bath.

EXAMPLE 2

600 ml of distilled water are heated to about 60° to 95° C. and the following components are successively added thereto:

20 ml of phosphoric acid, 220 ml of ammonia, and 30 gr of palladium in the form of palladium chloride. After the palladium chloride is dissolved, the pH value of the bath is adjusted to 7.3 by additions of ammonia or phosphoric acid as required and the bath is supplemented with distilled water to form a one liter solution, which is filtered before use.

In use, the above-bath is maintained at a temperature of about 60° to 65° C. and sprayed through the spray nozzles of a spray cell arrangement as described earlier onto a moving workpiece. The bath produces lustrous, crack-free palladium layers, with a current density of 140 A/dm$^2$ and an electrolyte flow of about 2.8 ml/sec per nozzle.

EXAMPLE 3

600 ml of distilled water are heated up to about 90° C. and the following components are successively added thereto:

20 ml of phosphoric acid, 220 ml of ammonia and 30 gr of palladium, from palladium chloride. After the palladium salt is dissolved, the pH value of the bath is adjusted to 7.3 by additions of ammonia or phosphoric acid as required and the bath is supplemented with additional distilled water to form a one liter bath.

In use, the above-formulated bath is maintained at a temperature of about 60° C. while a current having a density of about 60 A/dm$^2$ is applied across the bath and a workpiece and the electrolyte is pumped through the spray nozzles of a spray cell arrangement at a rate of about 1.7 ml/sec per nozzle. With these parameter, the bath produces lustrous and crack-free palladium layers on the workpiece.

EXAMPLE 4

600 ml of distilled water are heated to about 90° to 95° C. and the following components are successively added thereto:

20 ml of phosphoric acid, to 220 ml of ammonia and 10 gr of palladium, in the form of palladium chloride. After the palladium salt is dissolved, the pH value of the bath is adjusted to 7.8 by additions of ammonia or phosphoric acid as required and the bath is supplemented with additional distilled water to form a one liter bath.

Prior to use, the above-formulated bath is filtered and its temperature adjusted to about 70° C. while a current having a density of about 40 A/dm$^2$ is applied across the bath and a workpiece and the electrolyte is stirred with a rotating disc electrode operating at 10,000 rpm. With these parameters, the bath produces silky matte through matte crack-free palladium layers.

EXAMPLE 5

600 ml of distilled water are heated to about 90° to 95° C. and the following components are successively added to the heated water:

20 ml of phosphoric acid, 150 ml of ammonia and 10 gr of palladium, in the form of palladium chloride. After the palladium salt is dissolved, the pH value of the bath is adjusted to 7.3 by additions of ammonia and/or phosphoric acid as required and the bath is supplemented with additional distilled water to form a one liter bath.

Prior to use, the above-formed bath is filtered and its temperature adjusted to about 65° C. A current having a density of about 10 A/dm$^2$ is applied across the bath and a workpiece and the electrolyte is stirred with a rotating disc electrode operating at about 4000 rpm. With these parameters, lustrous and crack-free palladium layers are produced on the workpiece.

As is apparent from the foregoing specification, the present invention is susceptible of being embodied with various alterations and modifications which differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-attended claims.

We claim as our invention:

1. An additive-free, fast-precipitating electrolyte bath for precipitating palladium layers, said bath being formulated by successively adding to distilled water heated up to about 90° C., phosphoric acid, sufficient ammonia to about neutralize said phosphoric acid and palladium chloride and adjusting the operating pH value of the resultant bath to about 6.5 through 8.5 by additions of ammonia or phosphoric acid as required.

2. An electrolyte bath as defined in claim 1 wherein further distilled water is added to said resultant bath to attain a desired final volume.

3. An electrolyte bath as defined in claim 2 wherein said bath is filtered after attainment of said desired volume.

4. An electrolyte bath as defined in claim 1 wherein a one liter bath is formulated by successively adding to about 600 ml of distilled water heated up to about 90° C., about 10 through about 100 ml of phosphoric acid having a density of about 1.71, sufficient 25% aqueous ammonia to substantially neutralize said acid and about 5 through about 40 gr of palladium chloride, adjusting the operating pH value of the resultant bath, after the palladium chloride is dissolved, to about 6.5 through about 8.5 by additions of ammonia or phosphoric acid as required, adding sufficient distilled water to attain a one liter volume and filtering the resultant bath prior to use.

5. A method of electrically precipitating a palladium layer onto a workpiece, comprising:

formulating an electrolyte bath by successively adding to distilled water heated up to about 90° C., phosphoric acid, sufficient ammonia to about neutralize said phosphoric acid, and palladium chloride and adjusting the operating pH value of the resultant bath to about 6.5 through 8.5 by additions of ammonia or phosphoric acid, as required;

adjusting the temperature of said bath so as to range from about 20° to 80° C. and positioning a workpiece to be electroplated in working relation with said bath;

applying an electrical current having a density of about 10 to 180 A/dm$^2$ across said bath and workpiece; and stirring said bath with a rotating disc electrode having an outer non-conductive cylindrical body with a diameter of about 10 mm and a metallic electrode disc at least partially embedded in the bottom surface of said body and having a diameter of about 2 mm, driven at a rotational speed of about 3,600 to 10,000 rpm.

6. A method of electrically precipitating a palladium layer onto a workpiece comprising:

formulating an electrolyte bath by successively adding to distilled water heated up to about 90° C., phosphoric acid, sufficient ammonia to about neutralize said phosphoric acid, and palladium chloride and adjusting the operating pH value of the resultant bath to about 6.5 through 8.5 by additions of ammonia or phosphoric acid as required;

adjusting the temperature of said bath so as to range from about 20° to 80° C. and positioning a workpiece to be electroplated in working relation with said bath;

applying an electrical current having a density of about 10 to 180 A/dm$^2$ across said bath and workpiece; and spraying said electrolyte bath against surfaces of said workpiece to be electroplated at a rate of about 1 to 15 ml/sec per unit area of said workpiece.

7. A method as defined in claim 6, wherein said spraying occurs by pumping said bath through a spray cell system comprising a plurality of spray nozzles positioned in at least one row extending in a given direction and in fluid communication with a reservoir for said electrolyte bath, each nozzle having an individual stream of electrolyte emerging unimpeded therefrom so as to impinge against at least a portion of said workpiece, and moving said workpiece along said given direction of said nozzles so that successive surface areas of said workpiece are contacted by said streams of electrolyte emerging from the individual nozzles to enable a free and unimpeded electroplating of said workpiece surface areas contacted by said streams.

8. A method as defined in claim 7, wherein said individual nozzles each having a nozzle diameter of about 2 mm.

9. A method as defined in claim 6, wherein at least end portions of said workpiece not being contacted by said streams of electrolyte are constantly moistened with electrolyte.

10. A method as defined in claim 9, wherein said moistening occurs by positioning a trough in working relation with said workpiece and in fluid communication with said electrolyte bath so that portions of the workpiece contact the electrolyte within the trough.

* * * * *